US006407902B1

(12) United States Patent
Patty et al.

(10) Patent No.: US 6,407,902 B1
(45) Date of Patent: Jun. 18, 2002

(54) CONTROL SYSTEM FOR A SOLENOID VALVE DRIVER USED TO DRIVE A VALVE OF A COMPRESSION CYLINDER

(75) Inventors: Alfred C. Patty, Portage, IN (US); Rudolph D. Nuzzo, Sayreville, NJ (US)

(73) Assignee: Dietrich Industries, Inc., Pittsburgh, PA (US)

( * ) Notice: Subject to any disclaimer, the term of this patent is extended or adjusted under 35 U.S.C. 154(b) by 0 days.

(21) Appl. No.: 09/515,003

(22) Filed: Feb. 29, 2000

(51) Int. Cl.[7] ..... H01H 47/04
(52) U.S. Cl. ..... 361/160
(58) Field of Search ..... 361/160

(56) References Cited

U.S. PATENT DOCUMENTS 3,878,376 A 4/1975 Sholes, Jr. et al. ..... 700/281
4,295,177 A 10/1981 Woodhouse et al. ..... 361/154
4,479,161 A * 10/1984 Henrich et al. ..... 361/154
4,737,882 A 4/1988 D'Onofrio ..... 361/154
4,825,333 A 4/1989 Clive et al. ..... 361/154
4,964,014 A * 10/1990 Boe et al. ..... 361/187
5,373,411 A * 12/1994 Grass ..... 361/64
5,748,431 A 5/1998 Goodnight et al. ..... 361/154
5,918,195 A * 6/1999 Halgrimson et al. ..... 702/94
6,019,441 A 2/2000 Lloyd et al. ..... 303/156
6,154,354 A * 11/2000 Alexanian ..... 361/160

* cited by examiner

*Primary Examiner*—Adolf Deneke Berhane
*Assistant Examiner*—Pia Tibbits
(74) *Attorney, Agent, or Firm*—Kirkpatrick & Lockhart LLP

(57) ABSTRACT

A control system for controlling a solenoid valve driver used to drive a valve of a compression cylinder, including a power supply, a controller, and a first switching device having a first terminal connected to a first output terminal of the power supply, a second terminal connected to a coil of the solenoid valve driver, and a control terminal connected to a first output terminal of the controller.

11 Claims, 5 Drawing Sheets

CONTROL SYSTEM FOR A SOLENOID VALVE DRIVER USED TO DRIVE A VALVE OF A COMPRESSION CYLINDER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

1. Field of Invention

The present invention relates generally to control systems and, more particularly, to systems for controlling a solenoid valve driver used to drive a valve of a compression cylinder.

2. Description of the Background

Hydraulic presses find wide application in modem industry, such as in the manufacture of galvanized steel studs. Typically, the manufacture of studs includes passing the studs through a multi-pass rollforming machine. While being rollformed, the studs are punched with holes of various shape and size. Thereafter, the studs are cut to their desired length. The punch and cutoff systems are typically activated by flying hydraulic presses.

In such hydraulic presses, valves are commonly used to govern the flow of hydraulic fluid into and out of the compression cylinders of the hydraulic presses. The shifting of the valve spools of the valves is ordinarily controlled by valve drivers, which are typically solenoids. In the prior art, the solenoids are typically powered by voltage-amplified control signals. These control signals, however, are typically of a low power. Thus, the dwell time of the solenoid necessary to fully shift the valve spools of the valves must be increased. As a result, the valves open and close relatively slowly. Moreover, the mass, and thereby the size, of the valves must be kept small so as to not further slow the opening and closing of the valves. This, in turn, limits the available sizes for the valve openings. The limitations in the size of the valve openings and the shifting of the valve spools limit the size of the hydraulic compression cylinders that can used in the hydraulic press system. As a consequence, smaller compression cylinders are typically used, which must be operated at higher operating pressures in order to achieve the same force as otherwise achievable with a larger cylinder. In modern rollforming applications, for example, the operating pressure for the hydraulic punch and cutoff systems typically range from 1600 PSI to 3600 PSI, with dwell times of approximately 0.050 to 0.100 milliseconds. At such high operating pressures, however, mechanical components of the hydraulic presses tend to wear out or break quickly.

Accordingly, there exists a need for a manner to minimize the dwell time of the valve driver of a hydraulic press system in order that the operating pressure of the press may be reduced.

BRIEF SUMMARY OF INVENTION

The present invention is directed to a control system for controlling a solenoid valve driver used to drive a valve of a compression cylinder, such as a hydraulic compression cylinder or a pneumatic compression cylinder. According to one embodiment, the control system includes power supply, a controller, and a first switching device having a first terminal connected to a first output terminal of the power supply, a second terminal connected to a coil of the solenoid valve driver, and a control terminal connected to a first output terminal of the controller.

The present invention provides a manner in which to reduce the dwell time of the solenoid valve driver of a hydraulic press, thereby permitting the use of larger compression cylinders, which in turn permits a concomitant reduction in the operating pressure of the press. Consequently, by permitting a reduction in the operating pressure of the press, the life of mechanical components of the press may be extended. The present invention also permits faster production line speeds, which translates to increased productivity, because the press may operate at a higher speed because the dwell time of the valve driver is reduced. These and other benefits of the present invention will be apparent from the detailed description of the invention hereinbelow.

DESCRIPTION OF THE FIGURES

For the present invention to be clearly understood and readily practiced, the present invention will be described in conjunction with the following figures, wherein.

DETAILED DESCRIPTION OF THE INVENTION

Figure 1:
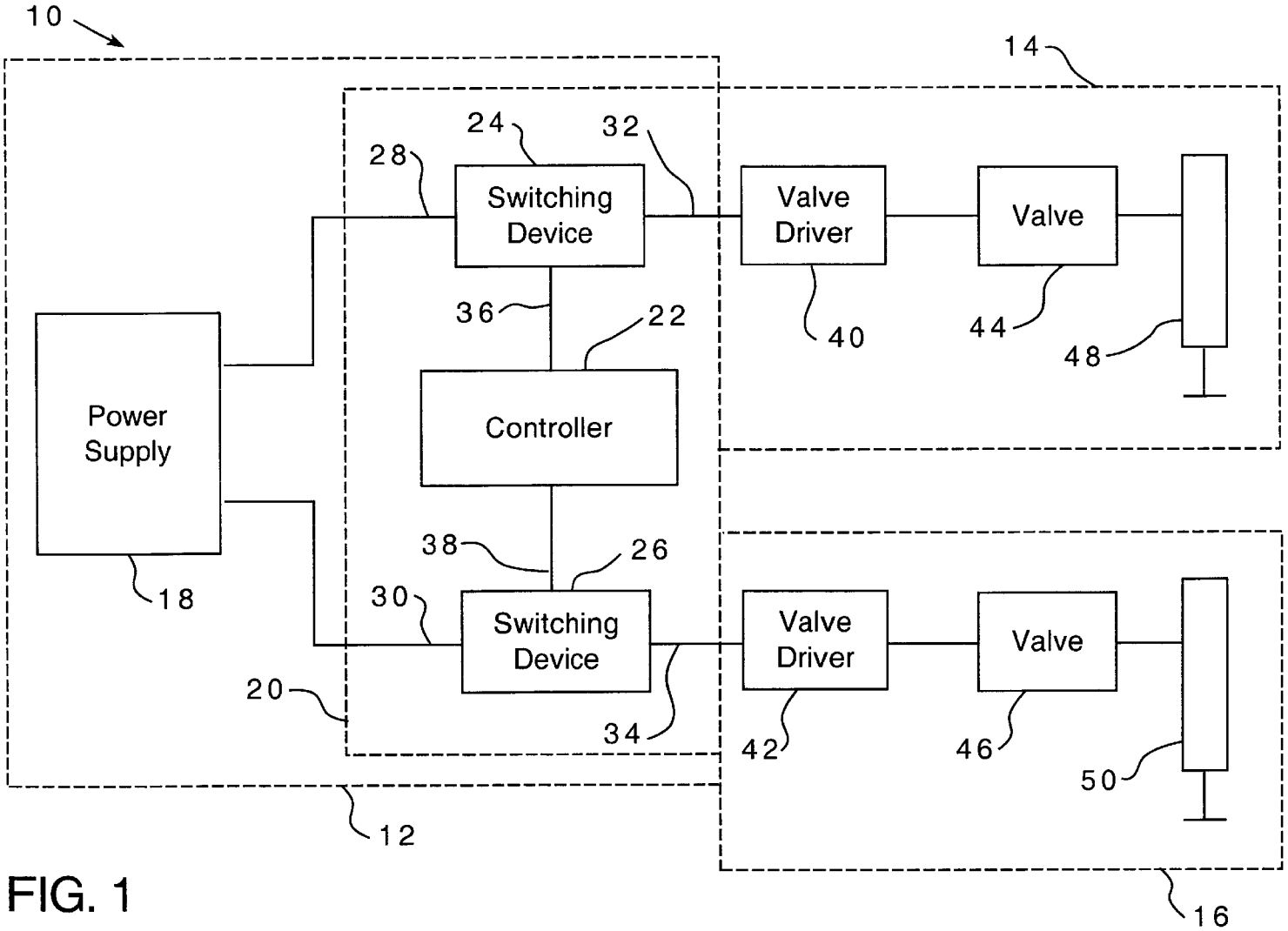
FIG. 1 is a block diagram of a system according to one embodiment of the present invention.

FIG. 1 is a block diagram of a system 10 according to one embodiment of the present invention. The system 10 includes a control system 12 for controlling a first hydraulic system 14 and a second hydraulic system 16. The control system 12 includes a power supply 18 and a control circuit 20. The control system 12 will be described herein as being used to provide control for two hydraulic systems 14, 16, although benefits of the present invention may be realized for systems including only one hydraulic system, as well as for systems having more than two hydraulic systems. In addition, although the present invention will be described herein as including hydraulic compression cylinders, benefits of the present invention may also be realized for systems including pneumatic compression cylinders.

The power supply 18 may output a regulated DC voltage at a specific current on one or more output terminals. The power supply 18 may be, for example, an AC-to-DC converter which converts an input AC voltage waveform to the desired output voltage. According to such an embodiment, the power supply 18 may be, for example, a linear regulated power supply or a switch-mode power supply. According to one embodiment, the power supply 18 outputs a steady DC voltage of, for example, 48 volts with a current of 4.8 amps from a 110 V AC input. According to other embodiments, the power supply 18 may be a DC-to-DC converter for converting a regulated or unregulated DC voltage to the desired DC output voltage. According to other embodiments, the power supply 18 may be, for example, an uninterruptible power supply (UPS) or a battery.

The control circuit 20 includes a controller 22, a first switching device 24, and a second switching device 26. The controller 22 may be implemented as, for example, a microprocessor, an application specific integrated circuit (ASIC), or a computer, such as a workstation or a personal computer. The controller 22 may output separate control signals to control the flow of hydraulic fluid for each of the hydraulic systems 14, 16.

The first and second switching devices 24, 26 may each have an input terminal 28, 30 connected to one of the output terminals of the power supply 18, and may each have an output terminal 32, 34 connected to the hydraulic systems 14, 16. The first and second switching devices 24, 26 may be used to couple the output voltage from the power supply 18 to the hydraulic systems 14, 16 in response to control signals received from the controller 22 at control terminals 36, 38 of the respective switching devices 24, 26. The switching devices 24, 26 may be, for example, relays, such as solid state relays (SSRs) or electromechanical relays, solid state devices, such as transistors, or a combination thereof. For an embodiment in which the switching devices 24, 26 are relays, the switching devices 24, 26 may be, for example, single pole or double pole devices.

The first and second hydraulic systems 14, 16 may each include a valve driver 40, 42, a valve 44, 46, and a hydraulic cylinder 48, 50 respectively. The valves 44, 46 may be, for example, double acting valves including valve spools for opening and closing the openings through which hydraulic fluid may flow into and out of the hydraulic cylinders 48, 50. The hydraulic fluid, when not in the hydraulic cylinders 48, 50, may be stored in a hydraulic fluid reservoir (not shown).

Figure 1A:
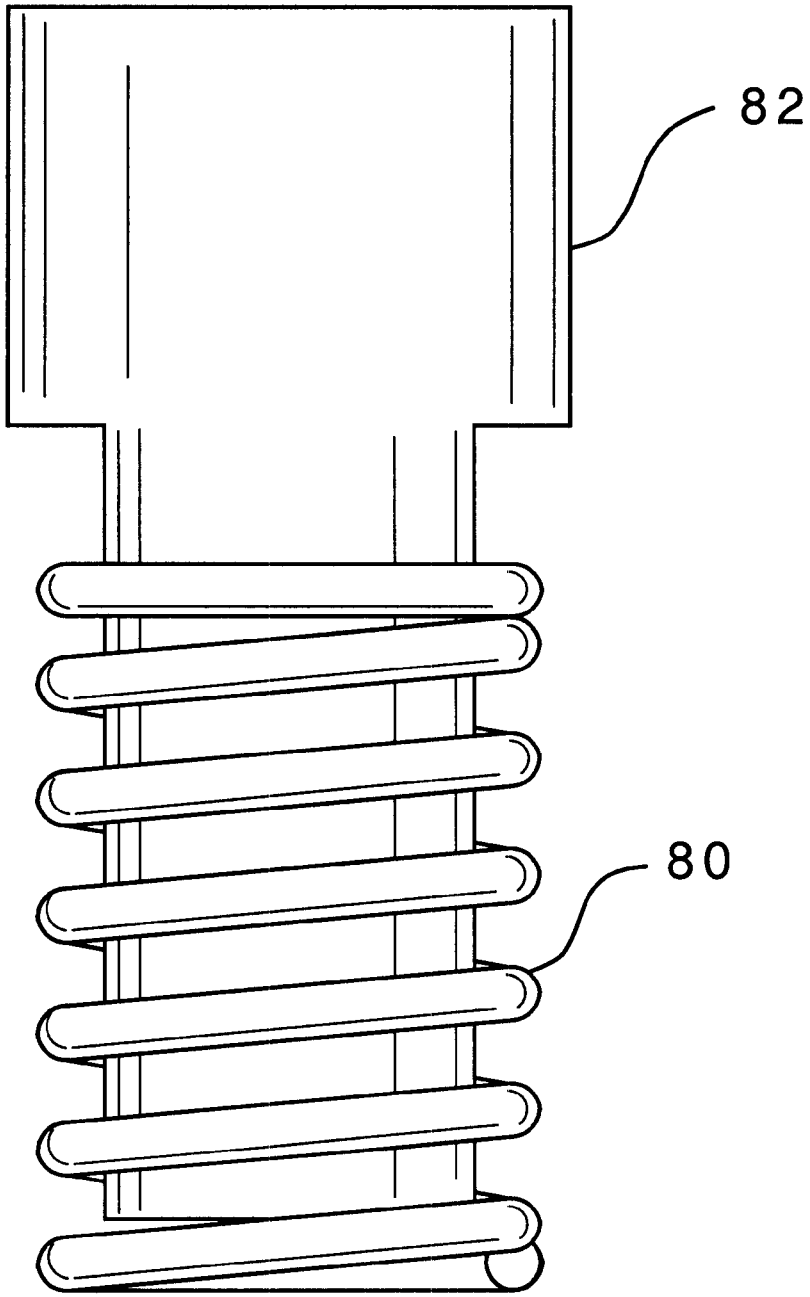
FIG. 1A is a diagram of a solenoid.

The valve drivers 40, 42 may be, for example, solenoids including, as illustrated in FIG. 1A, a coil 80 and an ferrous armature 82 disposed therein. The coil of the solenoid valve drivers 40, 42 may be coupled to the power supply 18 via the switching devices 24, 26 respectively. The coils of the solenoid valve drivers 40, 42 may be energized from the current output from the power supply 18 when the respective switching devices 24, 26 are closed, thereby coupling the valve drivers 40, 42 to the power supply 18. Conversely, the coils of the solenoid valve drivers 40, 42 may be de-energized upon opening of the respective switching devices 24, 26. The energizing/de-energizing of the coils of the solenoid valve drivers 40, 42, in conjunction with a spring bias, may induce linear mechanical movement of the armature disposed within the coil, which may drive the valve spools of the valves 44, 46. Accordingly, the energizing/de-energizing cycle of the solenoid valve drivers 40, 42 may shift the valve spool of the valves 44, 46 to thereby control the flow of hydraulic fluid into and out of the hydraulic cylinders 48, 50.

The control system 12 of the present invention may be utilized, for example, in a rollforming machine used to manufacture steel studs, where the first hydraulic system 14 is the punch system of the machine used to punch holes in the steel studs, and the second hydraulic system 16 is the cutoff system of the machine used to cut the studs to a predetermined length. It should be noted, however, that benefits of the present invention may be realized in any application requiring operational control of solenoid valve drivers and is not, therefore, limited to rollforming machines including hydraulic presses.

The controller 22 may output control signals to control the actuation of the armature of the respective solenoid valve drivers 40, 42 to thereby control the shifting of the valve spool of the valves 44, 46. For example, when the first switching device 24 is closed in response to the control signal from the controller 22, the power supply 18 supplies electrical current to the coil of the solenoid valve driver 40, inducing an electromagnetic flux field around the coil of the valve driver 40. According to various embodiments, the electromagnetic field attracts or repels the ferrous armature disposed in the coil. When the first switching device 24 opens in response to the control signal from the controller 22, the electromagnetic field is removed, and liner mechanical motion of the armature may be induced, for example, by the spring bias. The linear mechanical movement of the armature may be used to shift the valve spool of the valve 44, and thereby control the flow of hydraulic fluid into and out of the cylinder 48. The controller 22 may output control signals to the second switching device 26 to control the operation of the second hydraulic system 16 in a similar fashion. Accordingly, the controller 22 may control the operation of the valve drivers 40, 42, and hence the cylinders 48, 50.

The force required to actuate the armature of the solenoid valve drivers 40, 42 is related to the magnetic field generated by the respective solenoid valve drivers 40, 42. The magnetic field generated by the solenoid valve drivers 40, 42 is related to the amount of current flowing through the coil of solenoids and the amount of time that the current is flowing through the coil. The amount of time that current is flowing in the coils of the solenoid valve drivers 40, 42 is commonly referred to as the "dwell time", and corresponds to the period of time that the switching devices 24, 26 are closed, thereby coupling the valve drivers 40, 42 to the power supply 18. The control system 12 of the present invention permits a decrease in the dwell time required to actuate the armatures of the respective valve drivers 40, 42 to fully shift the valve spools of the valves 44, 46. This is because the valve drivers 40, 42 are powered by the power supply 18, and not by low power control signals from a controller, as in the prior art. Thus, in contrast to the prior art, it has been found that the power supply 18 can be coupled to the valve drivers 40, 42, resulting in the coils of the valve drivers 40, 42 being energized by signals having a greater power, and thereby permitting a reduction in the necessary dwell time. As described herein, therefore, hydraulic systems can be controlled both accurately and in real time with the present invention. In addition, with the control system 12 of the present invention, the hydraulic systems 14, 16 may employ larger valves 44, 46, which in turn permits the usage of larger hydraulic cylinders 48, 50, thereby permitting the operating pressure of the cylinders 48, 50 to be set at a lower setting to realize a given output force.

For example, the control system 12 of the present invention may be implemented in a rollforming machine used to manufacture steel studs, where the first hydraulic system 14 is used to punch holes in the studs and the second hydraulic system 16 is used to cut the studs to the desired length. The controller 22 may output control signals to the first switching device 24 at the appropriate times as the studs are passed through the rollforming machine to have holes punched in the studs by the first hydraulic system 14. In a similar fashion, the controller 22 may output control signals to the second switching device 26 at the appropriate times to have the studs cut off at a desired length by the second hydraulic system 18. The controller 22 may output control signals to the switching devices 24, 26 to activate the hydraulic systems 14, 16 at the appropriate time based on, for example, the hardness of the material comprising the studs.

According to one such embodiment, the power supply 18 may output a steady DC voltage of 48 volts at 4.8 amps. The dwell times for the solenoid valve drivers 40, 42 may be reduced to, for example, 0.065 to 0.045 milliseconds. Correspondingly, the operating pressures of the hydraulic cylinders 32, 34 may be reduced to, for example, 1800 to 750 PSI. This is a significant improvement over prior rollforming machines. As a consequence, the life of mechanical components of the hydraulic systems 14, 16 may be extended.

Figure 2:
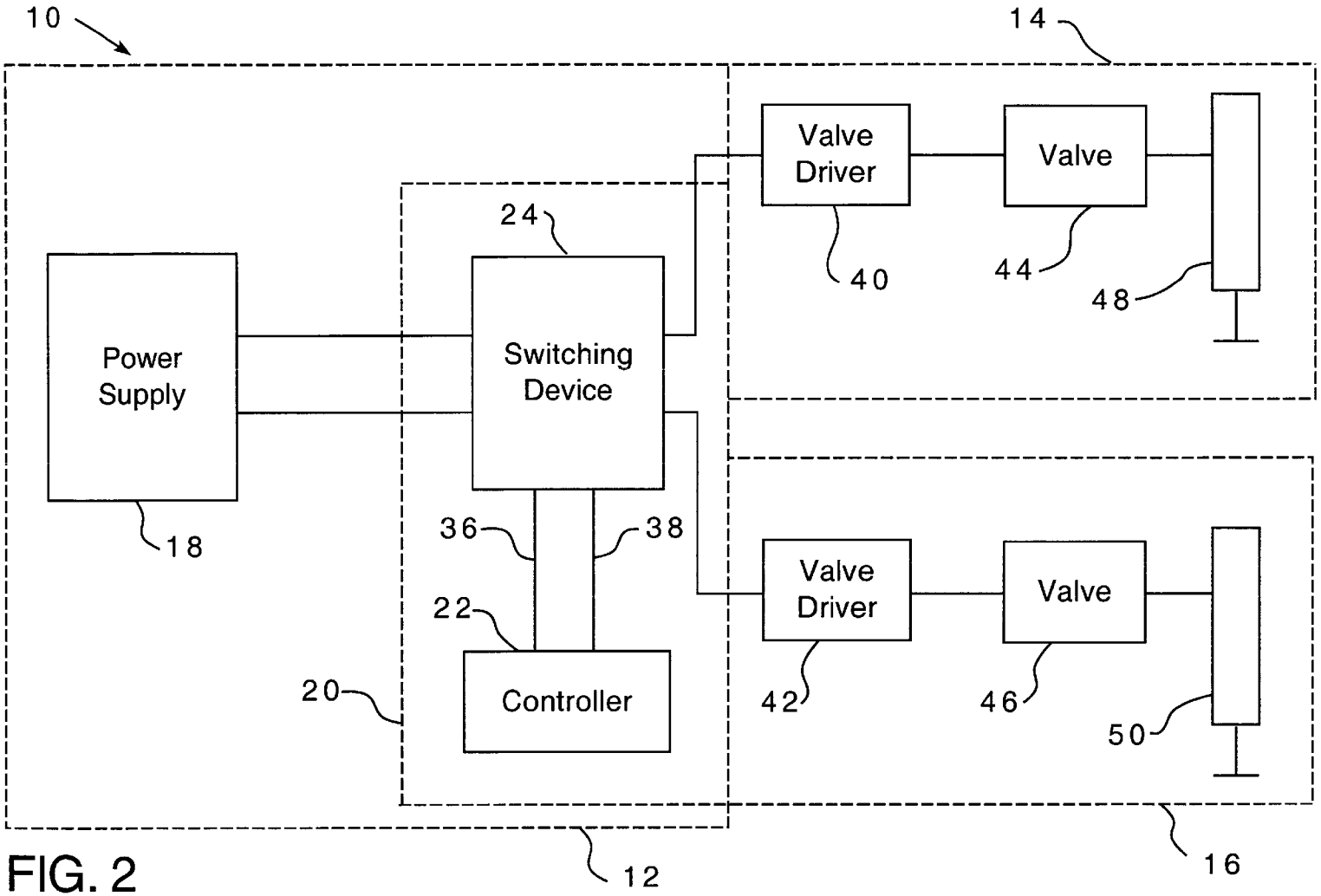
FIG. 2 is a block diagram of the system according to another embodiment of the present invention.

FIG. 2 is block diagram of the system 10 according to another embodiment of the present invention. The system 10 of FIG. 2 is similar to that of FIG. 1, except that the control circuit 20 includes one switching device 24 for coupling each of the valve drivers 40, 42 to the power supply 18 in response to control signals received at the control terminals 36, 38 from the controller 22. According to such an embodiment, the switching device 24 may be, for example, a solid state or electromechanical, double pole relay.

Figure 3:
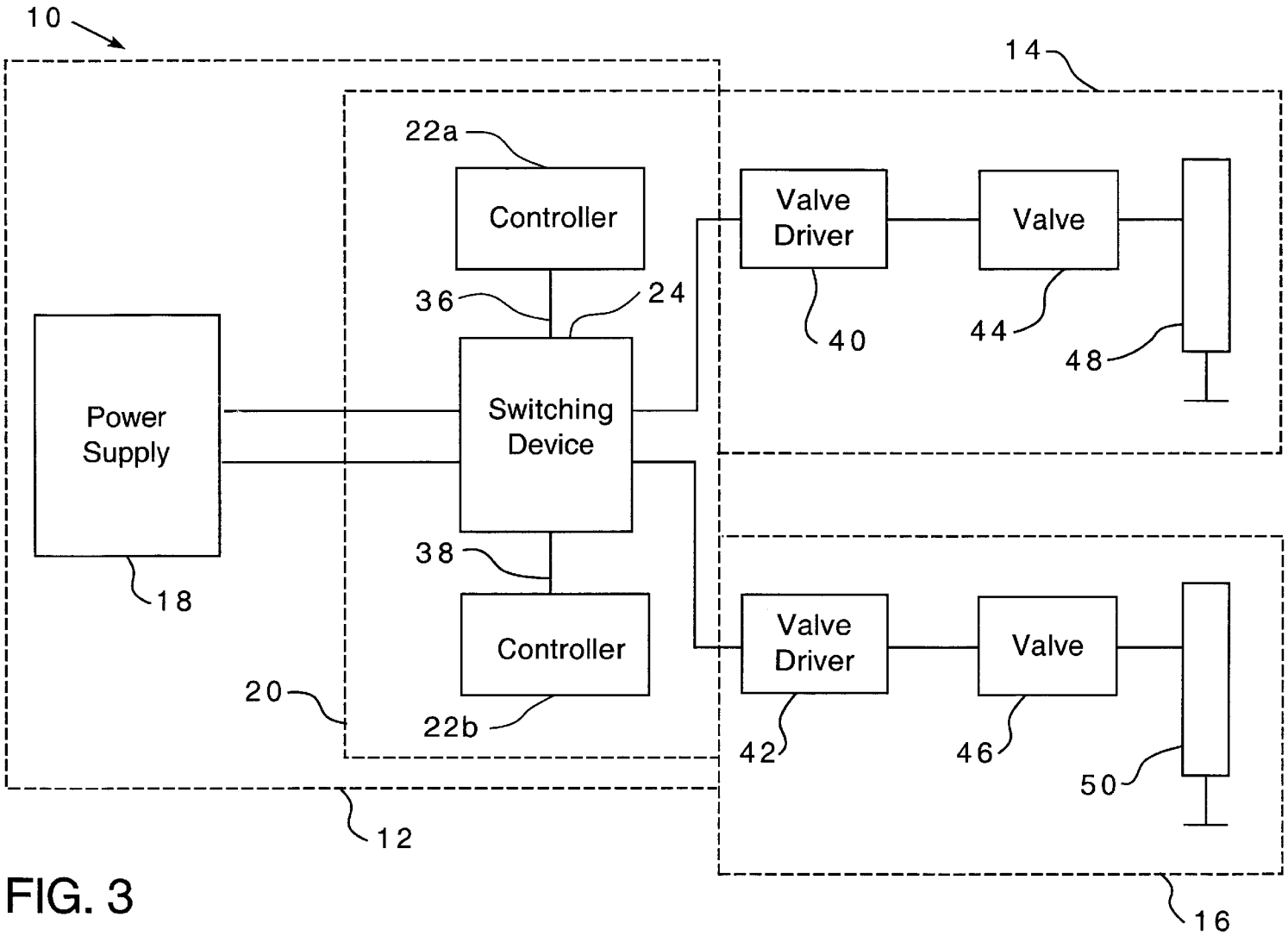
FIG. 3 is a block diagram of the system according to another embodiment of the present invention.

FIG. 3 is a block diagram of the system 10 according to another embodiment of the present invention. The system 10 of FIG. 3 is similar to that of FIG. 2, except that the control circuit 20 includes two controllers 22*a*, 22*b*. According to such an embodiment, the switching device 24 may couple the respective valve drivers 40, 42 to the power supply 18 in response to control signals from the separate controllers 22*a*, 22*b*. The first controller 22*a* may output a control signal to the switching device 24 to control the first hydraulic system 14 and the second controller 22*b* may output a control signal to the switching device 24 to control the second hydraulic system 16.

Figure 3A:
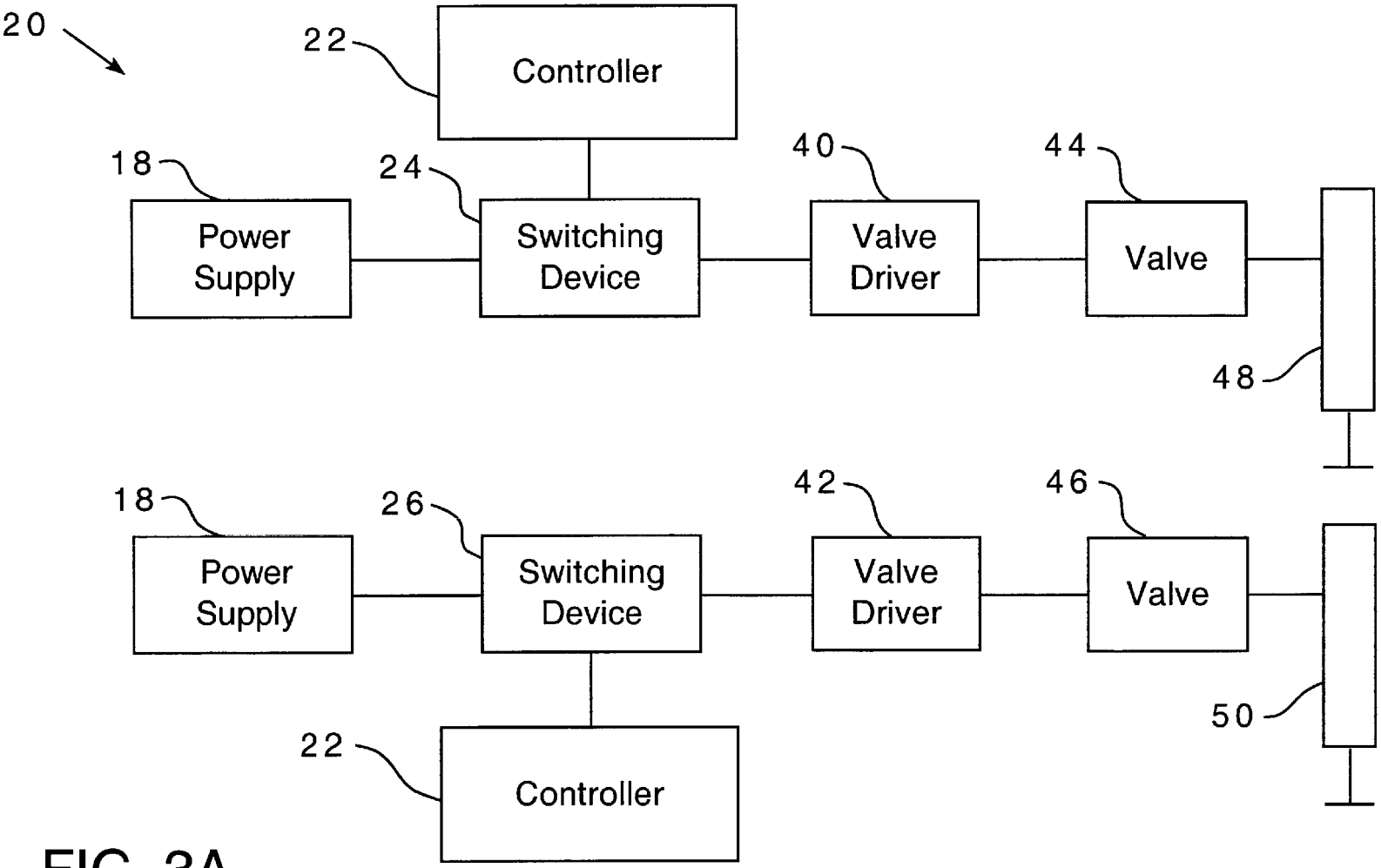
FIG. 3A is a block diagram of the system according to another embodiment of the present invention.

Although the present invention has been described herein in conjunction with certain embodiments thereof, those of ordinary skill in the art will recognize that many modifications and variations of the present invention may be implemented. For example, the control circuit 20 may include two controllers 22, where each of the controllers 22 is for controlling one of the switching devices 24, 26 respectively. According to another embodiment, the control system 12 may include two power supplies 18, wherein each switching device 24, 26 couples their respective valve driver 40, 42 to a separate power supply 18 in response to control signals from the controller 22. Such an embodiment may also include separate controllers 22, such that the control channels for each of the hydraulic systems 14, 16 are entirely separate, such as illustrated in FIG. 3A. That is, according to one embodiment, each of the valve drivers 40, 42 of the respective hydraulic systems 14, 16 may be driven by their own control channels, each control channel including separate power supplies 18, switching devices 24, 26, and controllers 22. The foregoing description and the following claims are intended to cover all such modifications and variations.

What is claimed is:

1. A control system for controlling a solenoid valve driver used to drive a valve of a compression cylinder, comprising:

a power supply;

a controller; and a first switching device having a first terminal connected to a first output terminal of the power supply, a second terminal connected to a coil of the solenoid valve driver, and a control terminal connected to a first output terminal of the controller.

2. The control system of claim 1, wherein the first switching device is selected from the group consisting of a relay and a transistor.

3. The control system of claim 1, wherein the first switching device is a relay selected from the group consisting of a solid state relay and an electromechanical relay.

4. The control system of claim 1, wherein the power supply is selected from the group consisting of an AC-to-DC converter, a DC-to-DC converter, an uninterruptible power supply, and a battery.

5. The control system of claim 1, further comprising a second switching device having a first terminal connected to a first output terminal of the power supply, a second terminal connected to a coil of a second solenoid valve driver, and a control terminal connected to a first output terminal of the controller, wherein the second solenoid valve driver is for driving a valve of a second compression cylinder.

6. The control circuit of claim 5, wherein:

the first switching device is selected from the group consisting of a relay and a transistor; and the second switching device is selected from the group consisting of a relay and a transistor.

7. The system of claim 5, wherein the controller includes:

a first controller having an output terminal connected to the control terminal of the first switching device; and a second controller having an output terminal connected to the control terminal of the second switching device.

8. The system of claim 5, wherein the power supply includes:

a first power supply having an output terminal connected to the first input terminal of the first switching device; and a second power supply having an output terminal connected to the first input terminal of the second switching device.

9. The control system of claim 5, wherein:

the first switching device includes a first solid state switching device; and the second switching device includes a second solid state switching device.

10. the control system of claim 1, wherein the first switching device includes a solid state switching device.

11. The control system of claim 10, wherein the first switching device is selected from the group consisting of a solid state relay and a transistor.

* * * * *

UNITED STATES PATENT AND TRADEMARK OFFICE

CERTIFICATE OF CORRECTION

PATENT NO. : 6,407,902 B1
DATED : June 18, 2002
INVENTOR(S) : Patty et al.

It is certified that error appears in the above-identified patent and that said Letters Patent is hereby corrected as shown below:

Column 1,
Line 21, remove “modem” and replace therewith -- modern --.

Signed and Sealed this

Fourteenth Day of October, 2003

JAMES E. ROGAN
*Director of the United States Patent and Trademark Office*